US008323168B2

(12) United States Patent
Naegelen et al.

(10) Patent No.: US 8,323,168 B2
(45) Date of Patent: Dec. 4, 2012

(54) CENTRIFUGAL SEPARATOR WITH VENTURI ARRANGEMENT

(75) Inventors: Sebastian Naegelen, Hamburg (DE); Klemens Dworatzek, Edingen (DE); Anthony W. Fell, Yeovil (GB); John Lawrence Mills, Ilminster (GB); Nigel Burford, Taunton (GB)

(73) Assignee: Mann+Hummel GmbH, Ludwigsburg (DE)

( * ) Notice: Subject to any disclaimer, the term of this patent is extended or adjusted under 35 U.S.C. 154(b) by 0 days.

(21) Appl. No.: 13/129,225

(22) PCT Filed: Nov. 12, 2009

(86) PCT No.: PCT/EP2009/065052

§ 371 (c)(1),
(2), (4) Date: Jun. 30, 2011

(87) PCT Pub. No.: WO2010/055091

PCT Pub. Date: May 20, 2010

(65) Prior Publication Data

US 2011/0263406 A1 Oct. 27, 2011

(30) Foreign Application Priority Data

Nov. 14, 2008 (GB) ..... 0820868.8

(51) Int. Cl.
*B04B 9/06* (2006.01)

(52) U.S. Cl. ..... 494/5; 494/49

(58) Field of Classification Search ..... 494/24, 494/36, 43, 49, 56, 64, 65, 67, 83, 84, 901, 494/60, 74, 79, 5; 210/168, 171, 232, 360.1, 210/380.1, 416.5; 184/6.24
See application file for complete search history.

(56) References Cited

U.S. PATENT DOCUMENTS 2,373,349 A * 4/1945 Serrell ..... 494/5
(Continued)

FOREIGN PATENT DOCUMENTS

GB 2296942 A 7/1996
GB 2406893 A * 4/2005

OTHER PUBLICATIONS

International Search report of PCT/EP2009/065052; Search report of related GB patent application GB082086808.

*Primary Examiner* — Charles E Cooley
(74) *Attorney, Agent, or Firm* — James Hasselbeck

(57) ABSTRACT

The invention describes a self-powered centrifugal separator comprising a base, a rotor mounted on an operably substantially vertical axis for rotation thereabout by reaction to fluid emission from rotor nozzles therein, a housing mounted on the base and enclosing the rotor, a sump formed in the base below the rotor, a fluid passageway through the base extending from an inlet port to an outlet port and including a diversion port to supply fluid to the interior of the rotor by way of the rotation axis, a drain passage in the base for draining fluid from the sump to the fluid passageway, and a venturi arrangement provided in the fluid passageway in the base to develop suction pressure to draw fluid from the drainage passage into the fluid passageway, whereas a spring loaded valve body is provided in the fluid passageway, said body being configured and arranged to shut off supply of fluid to the interior of the rotor when pressure of fluid entering the inlet port falls below a predetermined minimum pressure value and also to restrict and/or shut off supply of fluid to the interior of the rotor when pressure of fluid entering the inlet port rises above a second predetermined pressure value.

8 Claims, 8 Drawing Sheets

U.S. PATENT DOCUMENTS 5,904,841 A * 5/1999 Penny ..... 210/130
5,906,733 A * 5/1999 Purvey ..... 210/100
6,074,336 A * 6/2000 Purvey ..... 494/49
2011/0263406 A1* 10/2011 Naegelen et al. ..... 494/5

* cited by examiner

CENTRIFUGAL SEPARATOR WITH VENTURI ARRANGEMENT

CROSS REFERENCE TO RELATED APPLICATIONS

This application is US National Stage Entry of international patent application no. PCT/EP2009/065052, filed Nov. 12, 2009 designating the United States of America. Priority is claimed based on United Kingdom patent application no. GB 0820868.8, filed Nov. 14, 2008, the entire disclosure of which is incorporated herein by reference.

TECHNICAL FIELD

This invention concerns improvements to a fluid-powered centrifugal separator of the type which incorporates a venturi arrangement.

BACKGROUND OF THE INVENTION

Fluid-powered centrifugal separators are well known for separating fluids of different densities or for separating particulate matter from liquids and have long been used in lubrication systems for engines, particularly diesel-powered vehicle engines, as well as in other industrial separation processes.

The principle of operation of such a centrifugal separator is that a housing contains a rotor which is supported therein to spin at high speed about a substantially vertical axis. Fluid is supplied at elevated pressure along the axis of rotation and is ejected from tangentially directed nozzles into the housing from which it drains to a sump.

SUMMARY OF THE INVENTION

The present invention relates to so-called self-powered centrifugal separators of the type disclosed, for example, in U.S. Pat. No. 4,557,831, U.S. Pat. No. 4,498,898, and GB 2 160 796A, in which the drive fluid is the contaminated fluid to be cleaned. As this fluid passes through the rotor, denser contaminant materials or particles are separated therefrom centrifugally and retained in the rotor, typically as a cake adhering to the interior surface of the housing.

The fluid emerging from the rotor nozzles is in a low energy state and returns by gravity to the sump, which in turn drains by gravity flow to a liquid reservoir. Accordingly, in the context of a separator for engine lubrication fluid it is conventional to mount the separator above the level of the engine reservoir for lubrication fluid so that the static head of liquid in the holding sump (of the separator housing) provides adequate pressure for drainage.

Such drainage may also be hindered if a negative pressure with respect to ambient atmospheric pressure develops in the rotor housing. Provision of a ventilation or breather valve in the housing is a known means to deal with this, as disclosed in GB 2 296 942A.

In order to improve the rate of drainage of fluid from the rotor so that, in particular, such a centrifugal separator can be retro-fitted to a vehicle engine where there is no space for mounting it at a sufficient level above the system reservoir for lubrication fluid as previously required, it has been proposed in the applicant's earlier GB 2 296 942A to incorporate a venturi arrangement into the separator. This creates suction pressure to assist drainage of fluid (typically oil) to the system reservoir even if the latter is a considerable distance away or even above the centrifugal separator.

An object of the present invention is to enhance the operational efficiency and reliability of the type of self-powered centrifugal separator just described.

In respect of such separators it is already known to provide a spring biased valve in the flow path of the fluid to shut off flow at low pressure. This is shown in the applicant's earlier EP-A-1 009 535. This protects the engine by ensuring maximum supply of lubricating fluid thereto when the pressure is low, namely by not diverting fluid to the centrifugal cleaning means at such time.

It would also be desirable to protect the centrifugal separator from risk of damage which could occur as a result of too high a fluid pressure in the fluid supplied to the rotor, and too great a rotor speed being caused thereby.

With these objectives in view the present invention provides a centrifugal separator comprising a base, a rotor mounted on an operably substantially vertical axis for rotation thereabout by reaction to fluid emission from rotor nozzles therein, a housing mounted on the base and enclosing the rotor, a sump formed in the base below the rotor, a fluid passageway through the base extending from an inlet port to an outlet port and including a diversion port to supply fluid to the interior of the rotor by way of the rotation axis, a drainage passage in the base for draining fluid from the sump to the fluid passageway, and a venturi arrangement provided in the fluid passageway in the base to develop suction pressure to draw fluid from the drainage passage into the fluid passageway, characterised in that a spring loaded valve body is provided in the fluid passageway, said body being configured and arranged to shut off supply of fluid to the interior of the rotor when pressure of fluid entering the inlet port falls below a predetermined minimum pressure value and also to restrict and/or shut off supply of fluid to the interior of the rotor when pressure of fluid entering the inlet port rises above a second predetermined pressure value.

In preferred embodiments of the invention the valve body is provided with at least one opening which permits supply of fluid through the diversion port only when pressure of fluid entering the inlet port is between the predetermined minimum pressure value and a predetermined maximum pressure value, but the or each opening has a reduced cross-section in a direction towards the inlet port so as to restrict supply of fluid to the interior of the rotor when pressure of fluid entering the inlet port rises above a predetermined optimum pressure value, which is of course between the minimum and maximum values. In practice this is conveniently achieved by the opening having an adjoining surface recess which reduces in cross-section in a direction towards the inlet port. A gradually tapering cross-section may be provided in some embodiments.

Also a particularly advantageous development, which results in a compact structure and reduced complexity for assembly purposes during production, is that in preferred practical embodiments of the separator according to the invention the venturi arrangement is provided integrally with the valve body. Nevertheless, in other embodiments the venturi arrangement may still be separate from the valve body.

Another advantageous development is that in embodiments of the separator according to the invention, the valve body may be configured to include a non-return formation which co-operates with a shoulder or valve seat in the fluid passageway to prevent back flow of fluid from the outlet port. Such back flow may otherwise occur when the engine is switched off and the pump causing circulation of lubrication fluid through the separator is switched off. Preventing back flow therefore prevents the presence of significant fluid in the separator housing, and consequential loss of such fluid, upon maintenance or replacement of the separator during servicing of the engine.

BRIEF DESCRIPTION OF THE DRAWINGS

Further features and advantages of embodiments of centrifugal separators in accordance with the invention will be apparent from the following description, with reference to the accompanying drawings, in which.

DETAILED DESCRIPTION

Figure 1:
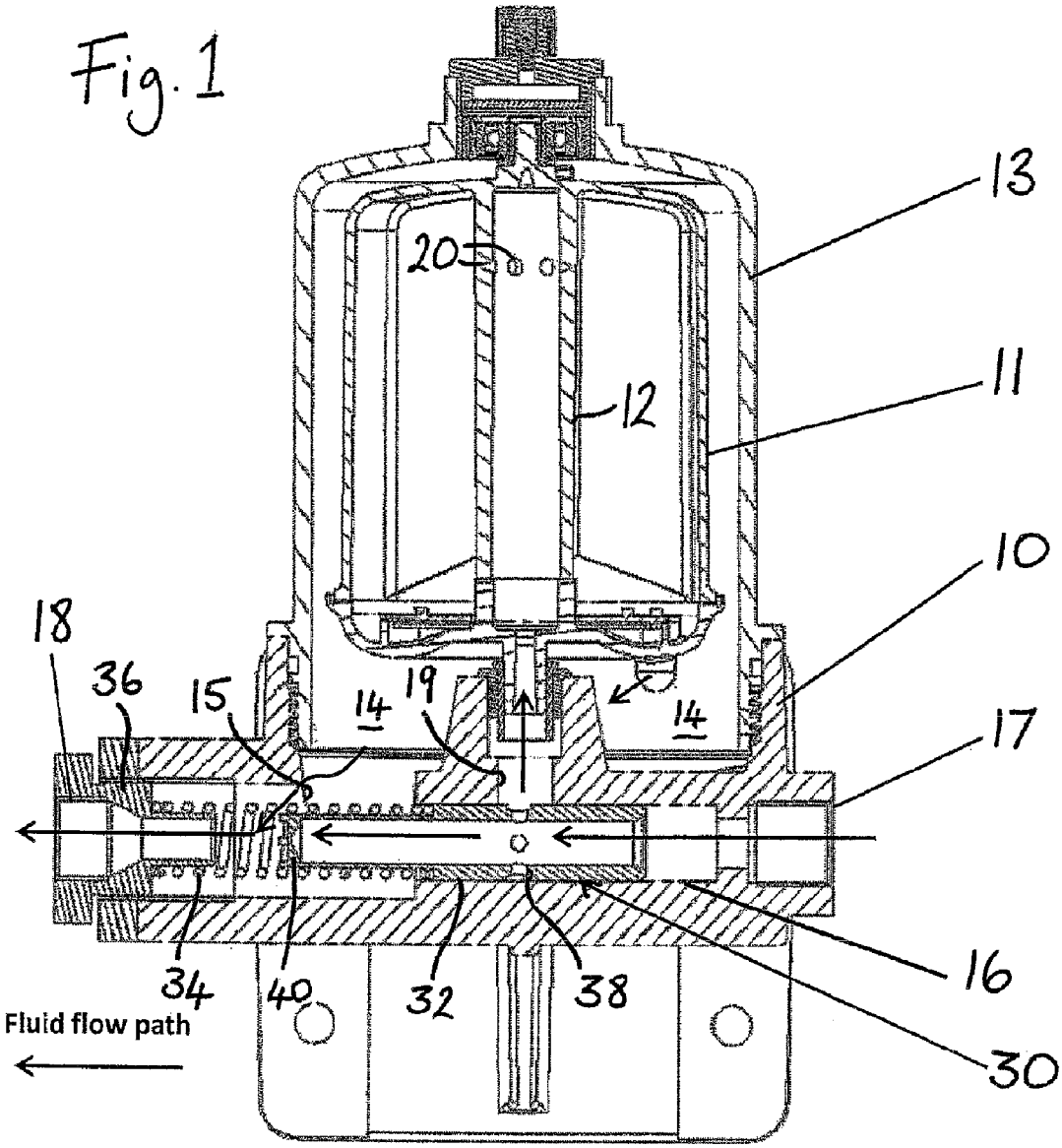
FIG. 1 is a longitudinal cross-section of a first practical embodiment of a centrifugal separator in accordance with the present invention.

Referring firstly to FIG. 1, this embodiment has the typical features of a self-powered centrifugal separator, namely a base 10, a rotor 11 mounted on a substantially vertical axis 12 for rotation thereabout, a housing 13 mounted on the base 10 and enclosing the rotor 11, and a sump 14 formed in the base 10 below the rotor 11. A fluid passageway 16 extends through the base 10 from an inlet port 17 to an outlet port 18. This fluid passageway 16 is arranged to supply fluid, through a diversion port 19, to the interior of the rotor 11 by way of the rotation axis 12. The fluid enters the rotor interior through apertures 20 in an upper region of the axis 12 and exits through tangentially directed nozzles (not shown) at the bottom of the rotor, reaction to which serves to spin the rotor 10 about its axis. Fluid from the nozzles drains into the sump 14. A drainage passage 15 connects the sump 14 to the passageway 16 for return, via the outlet port 18, to a system fluid reservoir (not shown). Solid contaminants in the fluid supplied to the rotor are forced outwardly by the rapid rotation of the rotor and are retained by the side walls of the rotor 10.

A shuttle valve 30 is mounted in the fluid passageway 16. This valve comprises a hollow body 32 mounted by way of a compression spring 34 to an extension of an outlet fitment 36 which is lodged In the outlet port 18. The valve body 32 is slidably adjustable within the passageway 16, acting against the bias of the spring 34, under the influence of the pressure of fluid supplied through the inlet 17. Openings 38 are provided in the hollow body 32 which are brought into alignment with the diversion port 19 when the inlet fluid pressure is at an optimum value for efficient operation of the separator. These openings 38 are shown in alignment with the diversion port 19 in FIG. 1.

The arrows in FIG. 1 shows the path of circulation of fluid through the separator with the shuttle valve 30 in the above described position.

Figure 3:
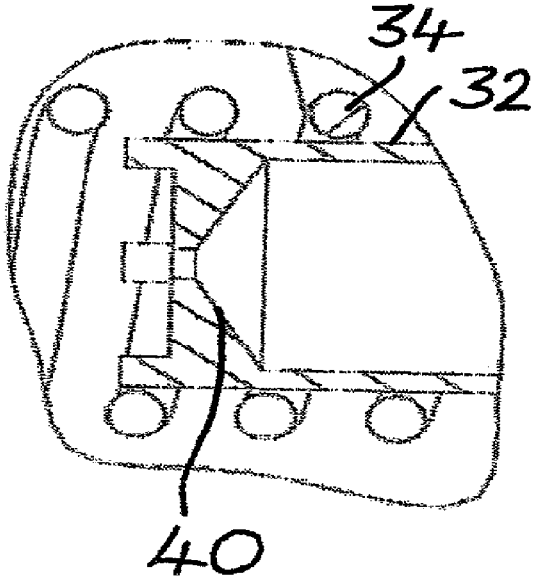
FIG. 3 is an enlarged detail of the region of the venturi nozzle of the valve body shown in FIG. 1.

The valve body 32 includes a venturi nozzle 40, which is shown in greater detail in FIG. 3. This provides a constriction which increases the pressure of fluid within the hollow interior of the valve body 32, but with consequent reduction in pressure downstream of the nozzle constriction, thereby creating a negative pressure (suction pressure) to draw fluid from the drainage passage 15, which communicates with the fluid passageway 16 downstream of the venturi nozzle 40.

When the inlet fluid pressure is lower than is the case in FIG. 1, the valve body 32 is displaced to the right as shown in this figure, under the influence of the spring 34, and the diversion port 19 is then closed so the rotor 11 does not operate. In a typical application the separator illustrated in FIG. 1 would be used to clean lubrication fluid of a vehicle engine and the fluid passageway 16 would be part of the circulation system for such lubrication fluid. Accordingly, when the pressure of fluid being pumped around the system is low, the closure of the diversion port 19 allows the low-pressure fluid to circulate directly to the engine without any diversion to the separator.

Figure 2:
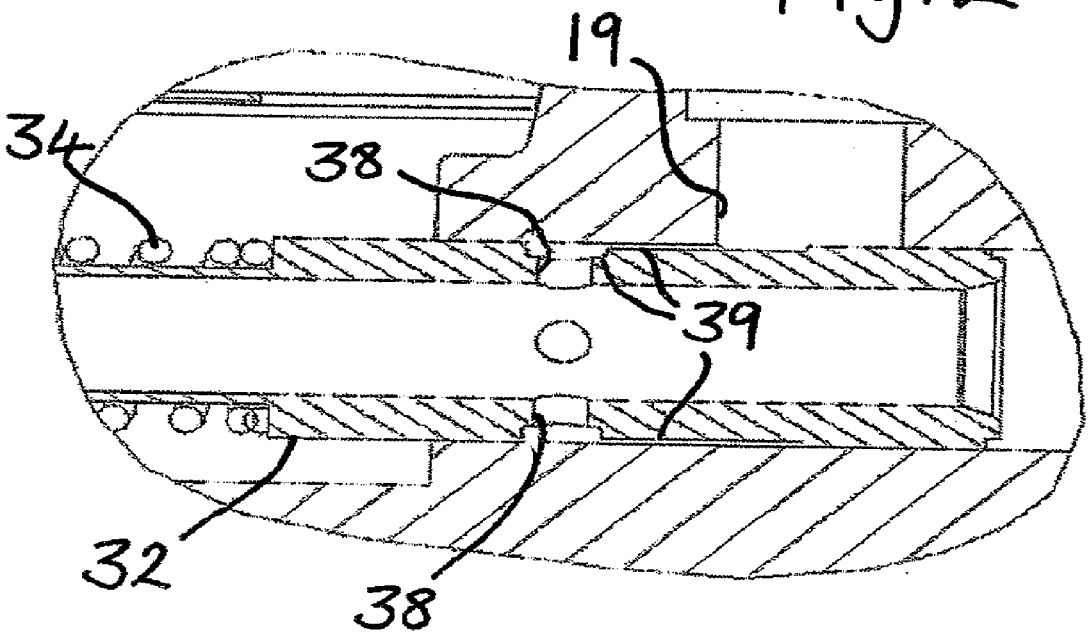
FIG. 2 is an enlarged detail of the region of the diversion port showing the position of the valve body when the inflow pressure to the separator is higher than in FIG. 1.

When the inlet fluid pressure is higher than is the case in FIG. 1, the valve body 32 is displaced to the left, to the position shown in enlarged detail in FIG. 2. It is apparent in this drawing that the openings 38 each include an enlarged diameter recess 39 in the exterior surface of the valve body 32, which recesses extend at reduced cross-section or depth in the direction of the inlet port 17. As these recesses 39 move into alignment with the diversion port 19, the overall cross-section of the through passage for flow of fluid from the interior of the valve body 32 to the vertical passage to the axis of the rotor 10 is reduced, the amount of fluid allowed through to the rotor is therefore reduced and the pressure of same is accordingly also reduced. Accordingly, as the pressure of fluid into the inlet port 17 increases above an optimal pressure, at which the main openings 38 move out of alignment with the port 19, the pressure of fluid to the rotor 11 is restricted and the rotor 11 is protected against possible malfunction and damage which may occur when too high a pressure of fluid is supplied there to.

Figure 4:
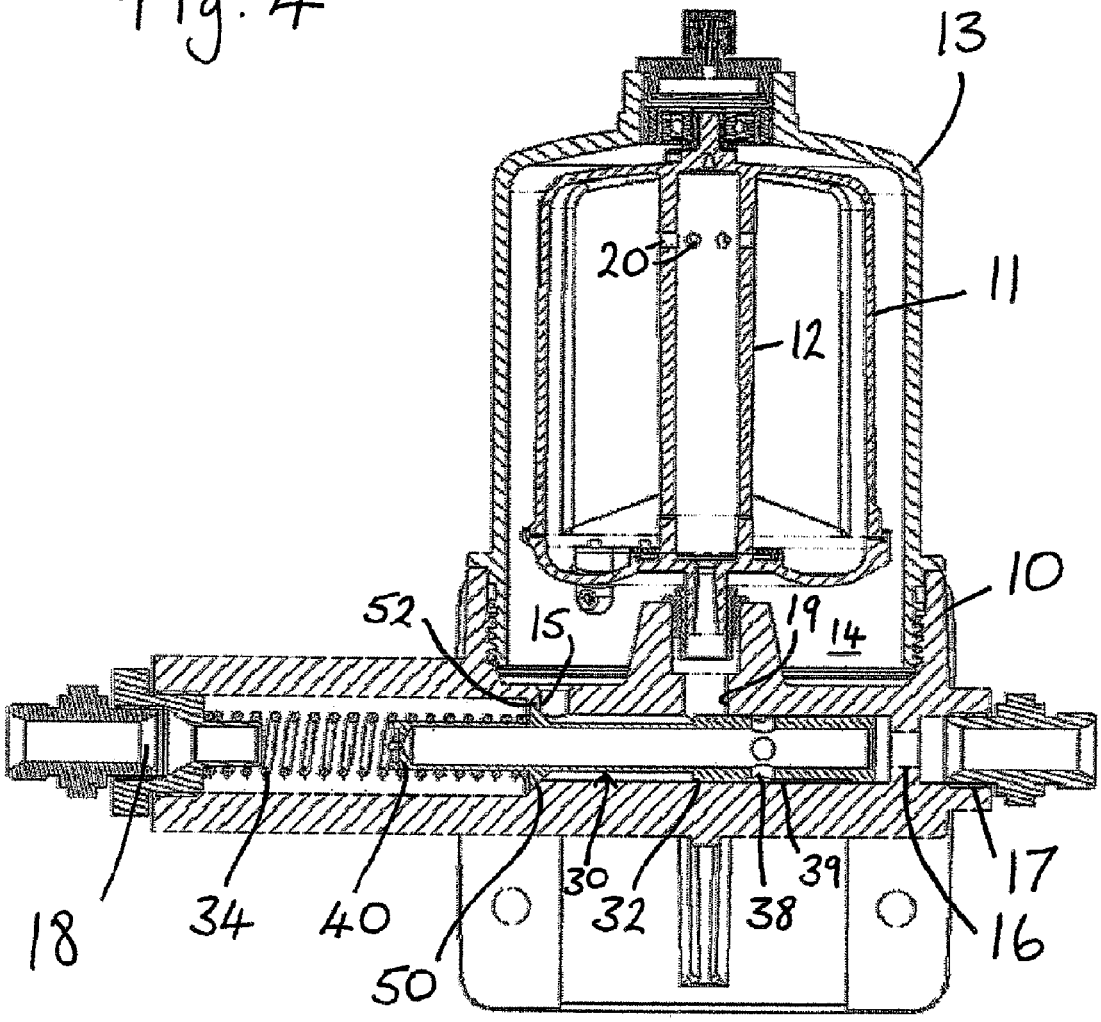
FIG. 4 is a longitudinal cross-section of a second practical embodiment of a centrifugal separator in accordance with the present invention.

Referring now to FIG. 4, this shows a further embodiment which is similar in all respects, just described above, to the embodiment of FIG. 1, but has the added advantage of including an integrated non-return valve formation 50 on the valve body 32. In so far as the features and component parts are the same as in FIG. 1, the same reference numerals have been used and to avoid unnecessary repetition, description of those will not be repeated.

Figure 5:
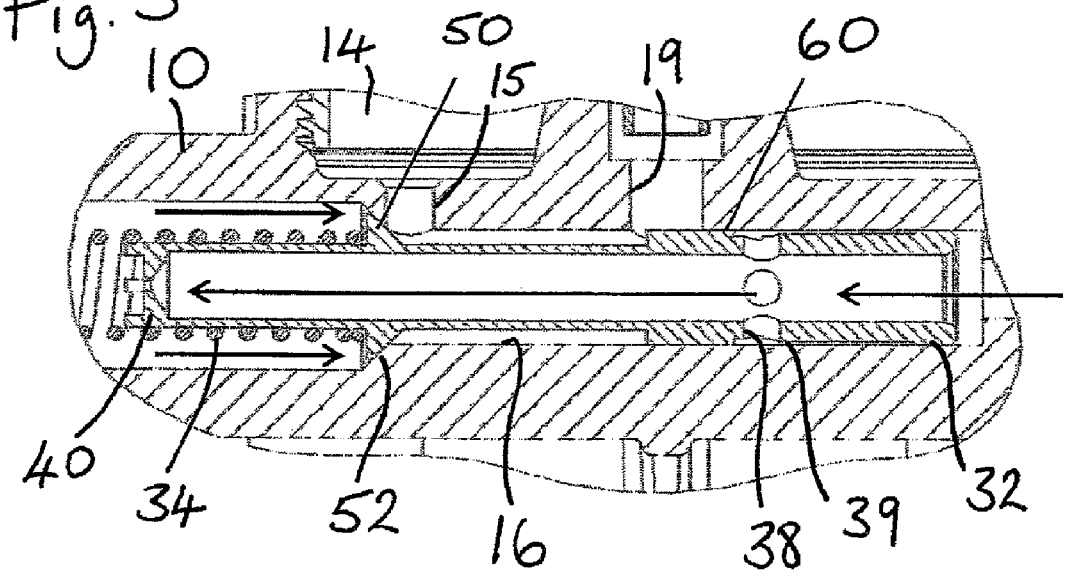
FIGS. 5 to 7 are enlarged detailed views of a region of the fluid passageway through the separator shown in FIG. 4 with the valve body shown in its respective positions at low, medium and high pressure of fluid flow into the separator.

The non-return formation 50, in this specific embodiment, takes the form of a frusto-conical ridge on the external surface of the body 32 of the shuttle valve 30. This co-operates with a corresponding sloping valve seat or shoulder 52 provided in the fluid passageway 16 of the separator base 10 adjacent the drainage passage 15 from the sump 14 in order to close the fluid passageway 16. The formation 50 will abut the seat 52 at low inlet pressure, as shown in FIG. 5, thereby preventing backflow from the outlet port 18. It will be appreciated that the particular configuration details of the non-return formation and its cooperating seat may vary in other versions.

Thus, at low inlet pressure, as shown in FIG. 5, the cut-off valve arrangement, designated by reference 60 and represented by the relative positions of the openings 38 in the valve body 32 and the diversion port 19, will be closed and the non-return valve 50 will also be closed. Consequently no fluid can flow into the rotor 11 and there can be no backflow into the rotor chamber. The advantages of both have already been explained. Preventing backflow minimises any fluid in the rotor when the separator is not operating and may need to be serviced or replaced. This makes the operation cleaner and also saves fluid.

Figure 6:
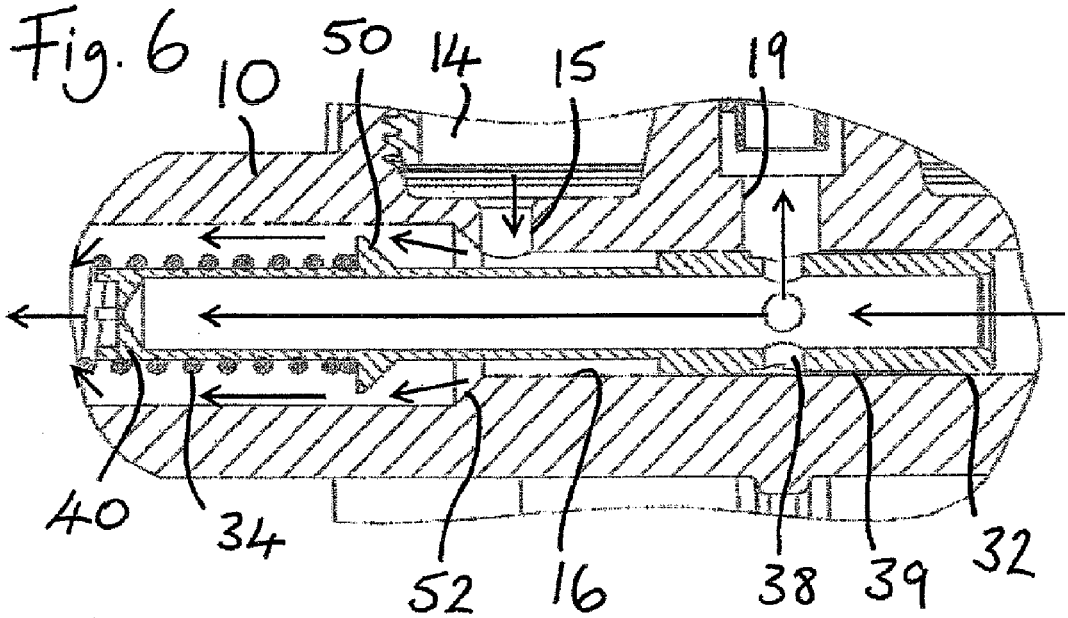

At medium inlet pressure, as shown in FIG. 6, both the valve arrangement 60 and the non-return valve 50 are open. Fluid flows into the rotor 11 and can drain past the non-return valve 50, with assistance of the venturi nozzle 40, as previously explained. The pressure is inherently sufficient to prevent backflow.

Figure 7:
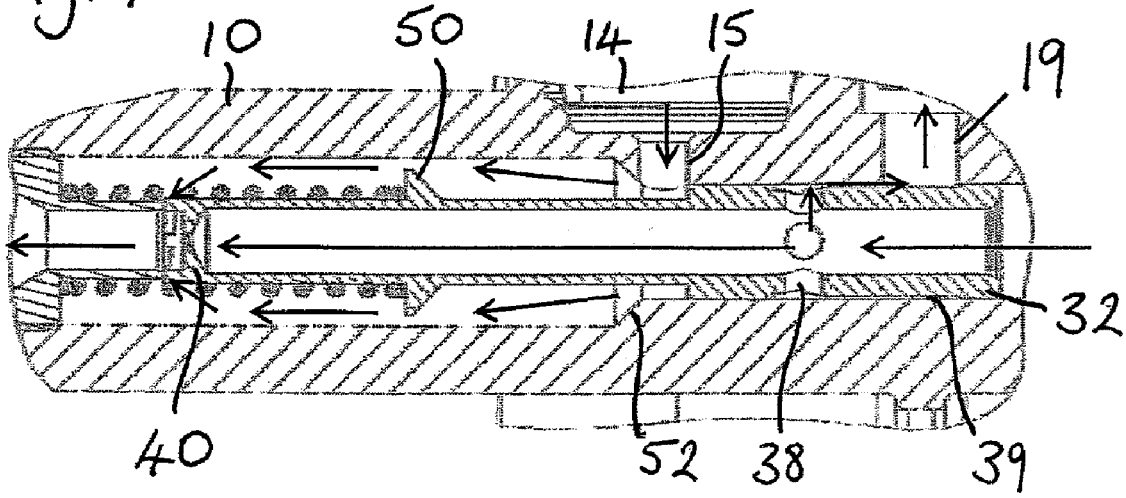

At high inlet pressure, as shown in FIG. 7, the non-return valve 50 is still open and the through flow pressure is inherently sufficient to prevent backflow. Just as a medium pressure, fluid flows into the rotor 11 and can drain past the non-return valve 50, with assistance of the venturi nozzle 40, as previously explained. However, at this higher pressure the cut-off valve arrangement 60 now restricts flow into the rotor 11, as previously explained, as the fluid must pass through the reduced cross-section of the recesses 39.

Figure 8:
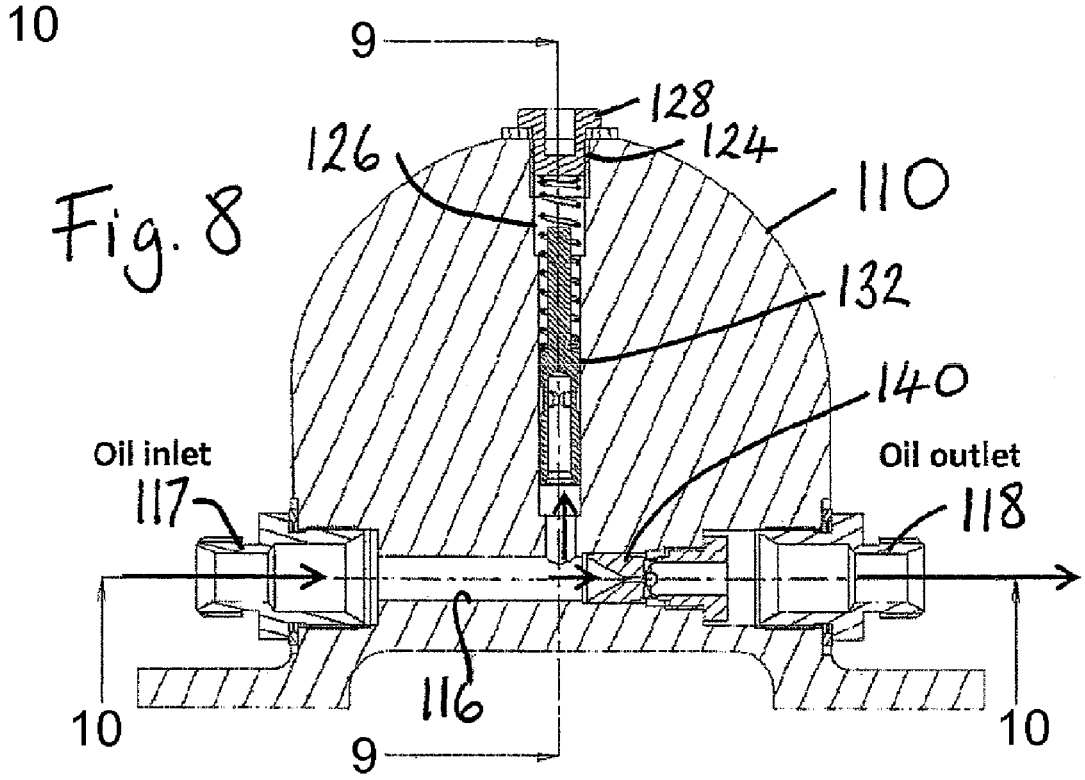
FIG. 8 is a transverse cross-section of a third practical embodiment of the centrifugal separator in accordance with the present invention, along line 8-8 in FIG. 10.
Figure 9:
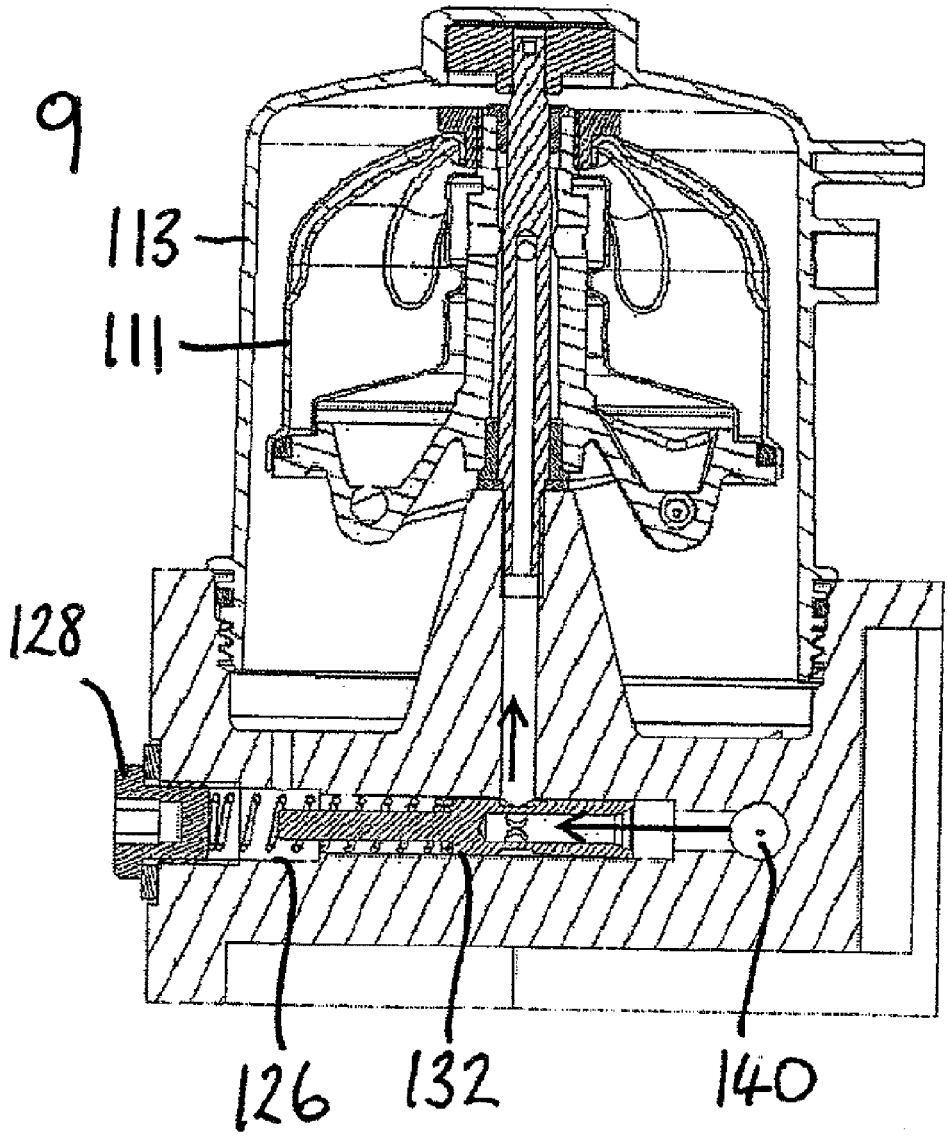
FIG. 9 is a longitudinal cross-section along line 9-9 in FIG. 8.
Figure 10:
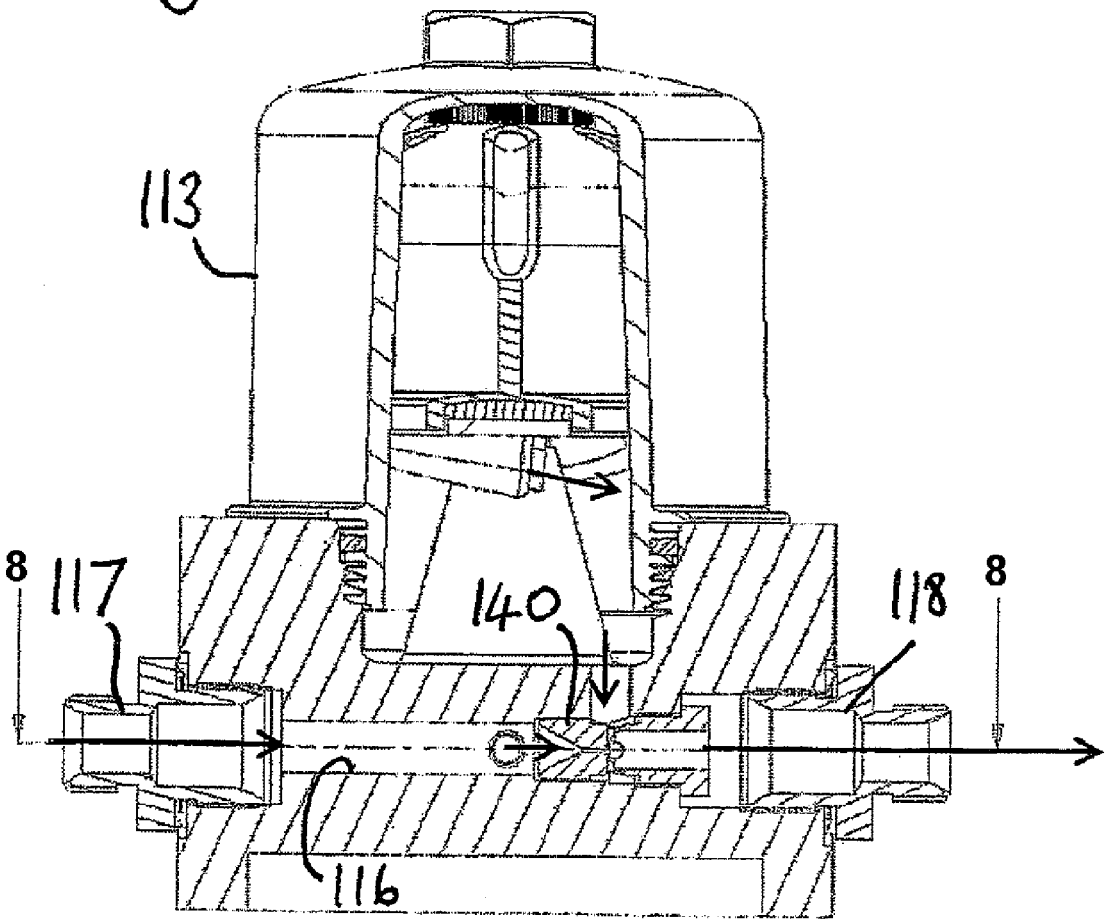
FIG. 10 it is a longitudinal cross-section along line 10-10 in FIG. 8.

Finally, FIGS. 8 to 10 show another embodiment of separator in accordance with the invention. In this embodiment features directly comparable to those already described in respect of the above embodiments are indicated by the same reference numerals increased by 100. They are not described further in any detail. The design of this embodiment is somewhat different in that the fluid passageway through the base 110 comprises a main passageway 116 extending from the inlet port 117 to the outlet port 118 and a branch passageway 126 extending from said main passageway, substantially perpendicular thereto, to an outlet 124 which is closed by a plug 128, as best seen in FIGS. 8 and 9. The diversion port 119 to supply fluid to the interior of the rotor 111 is provided in the branch passageway 126. The venturi arrangement 140 is provided in the main passageway 116 and the valve body 132 is provided, separately from the venturi arrangement 140, in the branch passageway 126. The valve body 132 is still provided with a suitable opening 138 which can be brought into and out of register with the diversion port 119 depending on the pressure of fluid flowing through the passageway 116 from the inlet 117 to the outlet 118 so that at the low-pressure flow to the port 119 is cut off, and at high pressure, above a predetermined maximum pressure, flow to the port 119 is also cut off. However, above a certain intermediate optimum pressure, up to the maximum pressure, flow is restricted by the reduced width of the recesses (see 39 at FIG. 2) which extend in the external surface of the valve body 132 in a direction from the openings 138 towards the inlet port 117, as in the preceding embodiments.

The foregoing is illustrative and not limitative of the scope of the invention and other variations in design details are possible as will be readily apparent to a person skilled in the art.

The invention claimed is:

1. A self-powered centrifugal separator, comprising:

a base having an inlet port and an outlet port;

a housing detachably mounted on said base, said housing and said base defining a closed fluid chamber therein;

a rotor arranged within said chamber and rotatably mounted and supported in said chamber for rotation about a substantially vertical axis for rotation thereabout by reaction to fluid emission from rotor nozzles, said housing and base enclosing said rotor, said rotor including a tubular rotation axis component extending axially along an axis of rotation of said rotor and arranged in an interior chamber of said rotor, said tubular rotation axis component having at least one hole extending through the tubular wall thereof enabling fluid to flow from an interior of said tubular axis rotation component into said rotor chamber;

a sump formed in said housing chamber at said base in an axial position below said rotor, said sump receiving fluid from said rotor;

a fluid passageway arranged in said base and extending between and fluid flow interconnecting said inlet port and said outlet port to communicate fluid flow between said inlet and said outlet ports;

a diversion port arranged in said base and operable to communicate fluid flow between said fluid passageway into said interior of said tubular rotation axis component to supply fluid to the interior of said rotor a drain passage arranged in said base and operable to communicate fluid flow between said sump and said fluid passageway, said drain passage for draining fluid from said sump;

a spring loaded valve body including a moveable valve body moveably arranged within said fluid passageway to slide within said fluid passageway;

a spring providing a loading force on said moveable valve body acting against inlet fluid pressure from said inlet port, said spring urging said moveable valve body to move towards a low inlet pressure position in said fluid passageway, wherein said spring loaded valve body is operable to shut off supply of fluid through said diversion port to said interior chamber of the rotor when pressure of fluid entering said inlet port falls below a predetermined minimum pressure value, wherein said spring loaded valve body is operable to restrict flow of and/or shut off supply of fluid through said diversion port to said interior of said rotor when pressure of fluid entering the inlet port rises above a second predetermined pressure value, wherein sliding movement of said valve is responsive to said inlet port fluid pressure, a venturi arrangement arranged in said fluid passageway of said base, said venturi arrangement including a nozzle restriction within said fluid passageway operable to develop suction pressure to draw fluid from said drainage passage into said fluid passageway;

wherein said moveable valve body is hollow forming a moveable valve body fluid flow passage within said moveable valve body extending from a first end of said moveable valve body to an opposing second end of said moveable valve body, wherein said moveable valve body fluid flow passage opens into said fluid passageway of said base to receive said fluid flow from said inlet port at a first end of said moveable valve body, and wherein said venturi arrangement is provided integrally with said moveable valve body at an opposing second end of said moveable valve body.

2. The self-powered centrifugal separator according to claim 1, wherein said moveable valve body is provided with an opening operable to permit fluid flow between said inlet port and said diversion port only when pressure of fluid entering said inlet port is between said predetermined minimum pressure value and a predetermined maximum pressure value.

3. The self-powered centrifugal separator according to claim 2, wherein said opening of said moveable valve body has a reduced fluid flow cross-section on said moveable valve body in a direction towards said inlet port, said reduced fluid flow cross-section operable to restrict flow of fluid from said inlet port into said interior of said rotor when pressure of fluid entering said inlet port rises above a predetermined optimum pressure value.

4. The self-powered centrifugal separator according to claim 3, wherein said opening of said moveable valve body has a gradually reducing fluid flow cross-section in a direction towards said inlet port.

5. The self-powered centrifugal separator according to claim 3, wherein said opening of said moveable valve body includes an adjoining surface recess formed in an exterior surface of said moveable valve body, said adjoining surface recess providing said reduction in fluid flow cross-section in a direction towards said inlet port.

6. The self-powered centrifugal separator according to claim 5, wherein said venturi arrangement is provided integrally with said moveable valve body, wherein said moveable valve body includes a non-return formation operable together with said fluid passageway of said base to prevent back flow of fluid from said outlet port into said fluid chamber of said housing and to said inlet port, and wherein said opening of said moveable valve body is arranged in a wall of said moveable valve body, one end of said opening of said moveable valve body in fluid flow communication with said moveable valve body fluid flow passage.

7. The self-powered centrifugal separator according to claim 1, wherein said moveable valve body includes a non-return formation operable together with said fluid passageway of said base to prevent back flow of fluid from said outlet port into said fluid chamber of said housing and to said inlet port.

8. The self-powered centrifugal separator according to claim 1, wherein said fluid passageway in said base comprises a main passageway arranged in said base and operable to communicate fluid flow between said inlet port to said outlet port;

a branch passageway arranged in said base and extending from said main passageway, said branch passageway operable to communicate fluid flow between said main passageway and said diversion port to supply fluid to said interior of said rotor, wherein fluid flow enters said interior of said rotor only through said branch passageway, wherein said venturi arrangement is arranged within said main passageway.

* * * * *